United States Patent [19]

Knorreck

[11] 4,441,472

[45] Apr. 10, 1984

[54] CHARGE-PRESSURE-DEPENDENT CONTROL APPARATUS FOR SUPERCHARGED FUEL-INJECTION ENGINES, IN PARTICULAR FOR DIESEL MOTOR VEHICLE ENGINES

[75] Inventor: Peter Knorreck, Weissach, Fed. Rep. of Germany

[73] Assignee: Robert Bosch GmbH, Stuttgart, Fed. Rep. of Germany

[21] Appl. No.: 404,806

[22] Filed: Aug. 3, 1982

[30] Foreign Application Priority Data

Sep. 18, 1981 [DE] Fed. Rep. of Germany ..... 3137145

[51] Int. Cl.[3] ..... F02D 1/04

[52] U.S. Cl. ..... 123/383; 123/382

[58] Field of Search ..... 123/383, 382, 385–388

[56] References Cited

U.S. PATENT DOCUMENTS

| | | | |
|---|---|---|---|
| 2,835,240 | 5/1958 | Braun | 123/382 |
| 3,981,285 | 9/1976 | Schueler et al. | 123/383 |
| 4,095,572 | 6/1978 | Scholtz | 123/383 |
| 4,228,774 | 10/1980 | Ritter et al. | 123/383 |
| 4,286,559 | 9/1981 | Ritter et al. | 123/383 |
| 4,372,268 | 2/1983 | Kolarik | 123/383 |

FOREIGN PATENT DOCUMENTS

| | | | |
|---|---|---|---|
| 2067663A | 7/1981 | United Kingdom | 123/383 |

*Primary Examiner*—Ira S. Lazarus
*Assistant Examiner*—Magdalen Moy
*Attorney, Agent, or Firm*—Edwin E. Greigg

[57] ABSTRACT

There is proposed a control apparatus (FIG. 1), which in order to prevent the emission of smoke upon acceleration of the engine, controls a damping stroke ($h_D$) preceding the adjusting stroke ($h_L$) which is controlled in accordance with charge pressure. The apparatus has a pressure chamber defined by a movable wall and connected via charge air line to the air inlet tube of the engine, and the movable wall actuates an adjusting member which varies the adjusting range or the full-load position of a supply quantity adjusting member of a fuel injection pump. A throttle device embodied as a sequence valve is inserted into a line connecting portion connecting the charge air line with the pressure chamber, and the stroke/time characteristic of the throttle device determines the damping stroke ($h_D$). The apparatus may be mounted either on the rpm governor or on the injection pump of Diesel motor vehicle engines.

7 Claims, 2 Drawing Figures

CHARGE-PRESSURE-DEPENDENT CONTROL APPARATUS FOR SUPERCHARGED FUEL-INJECTION ENGINES, IN PARTICULAR FOR DIESEL MOTOR VEHICLE ENGINES

BACKGROUND OF THE INVENTION

The invention is based on a control apparatus as generally described hereinafter. Control apparatuses of this general type are described, for instance, as charge-pressure-dependent full-load stops in U.S. Pat. No. 4,057,044 and the publication of Robert Bosch GmbH in Stuttgart (Federal Republic of Germany) entitled: "Diesel-Einspritzausrüstung (2) Drehzahlregler für Reiheneinspritzpumpen" [*Diesel Injection Equipment* (2), *RPM Governors for Series Injection Pumps*], VDT-UBP 210/1, dated Sept. 30, 1975, page 41, FIGS. 90 and 91. These control apparatuses correct the full-load position of the governor rod of the fuel injection pump in accordance with the charge air pressure in the air inlet tube of the engine for the sake of the appropriate adaptation of the full-load injection quantity. The known full-load stops operate between a reduced full-load position adapted to the intake quantity when there is no charge air pressure present, and an increased full-load quantity at maximum charge air pressure adapted to the so-called supercharger quantity. In diesel motor vehicle engines, if the engine is to be accelerated by means of pressing down on the gas pedal, then the injection quantity is abruptly increased from the idling quantity associated with the idling rpm to the intake quantity. However, since the engine accelerates in a delayed fashion, for a short time too much fuel is injected, which causes a drop in the combustion chamber temperature and very disadvantageously causes excessive smoke development.

In order to prevent excessive smoke development in the event of an overly rapid increase in fuel quantity, it has already been proposed in German Offenlegungsschrift No. 28 27 583 to use a retardation member such as a dash-pot as a control apparatus instead of a charge-pressure-dependent full-load stop. However, such an apparatus is not satisfactory on its own, so that it is an object of the present invention to realize the function of the two known apparatuses, with their respective advantages, within a single control apparatus.

OBJECT AND SUMMARY OF THE INVENTION

The control apparatus according to the invention combines the advantages of a retardation member and of a charge-pressure-dependent full-load stop in a surprisingly simple manner, without requiring a notably larger amount of space.

In accordance with the invention, the final control element rests on a first adjustable end stop when the engine is either shut off or is operating at idling rpm and at maximum charge air pressure rests on a second adjustable end stop and thus assures reliable functioning of the charge pressure stop containing the throttle device. The switchover point from damping function to the charge pressure control function is also adjustable in a simple manner.

As a result of the open throttle slit, it is possible in a simple manner to determine the throttle effect by means of the appropriate dimensioning of the slit; the open design of the slit additionally and particularly advantageously has a self-cleaning function. As a result of the second restoring spring, the characteristic of the damping stroke can be influenced in addition; further, the adjustment values for the adjustment stroke controlled in accordance with charge pressure and for the damping stroke are adjustable independently of one another.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
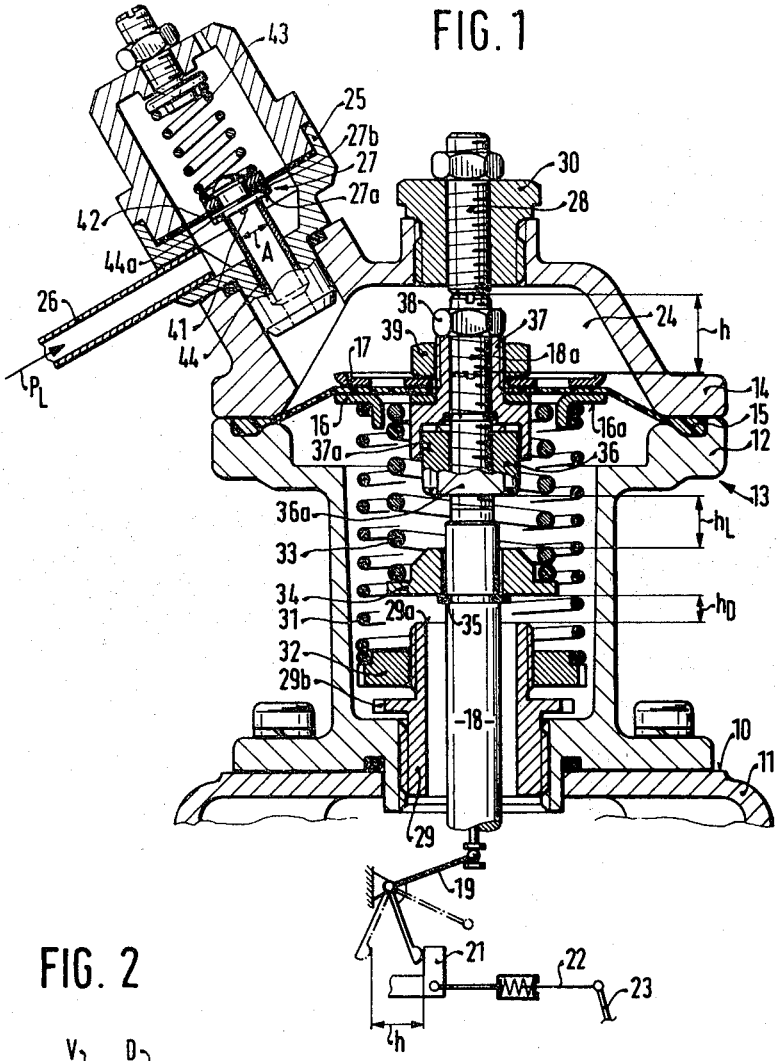
FIG. 1 is a longitudinal section taken through the charge-pressure-dependent control apparatus according to the invention.

Turning now to FIG. 1, a housing 12 of a charge-pressure-dependent full-load stop 13 is flanged to an end face 10 of an injection pump or governor housing 11. Between the housing 12 and a cap 14, an adjusting diaphragm 15 which serves as a movable wall is fastened in place and, reinforced by two plate disks 16 and 17, is firmly connected with a thrust rod 18 acting as the adjusting member.

As is illustrated in the drawing of the inside of the housing 11, the thrust rod 18 actuates a bell crank 19, which as a stop lever defines the maximum possible governor rod position at a particular time of a supply quantity adjusting member 21 of the injection pump. The supply quantity adjusting member 21 embodied as a governor rod is actuated in a known manner via a springy yielding strap 22, in accordance with the position of the driving pedal, by a governor lever 23 of the rpm governor.

A pressure chamber 24 inside the cap 14 defined on one side by the adjusting diaphragm 15 is connected by means of a line connection part 25 secured to the cap 14 to the air inlet tube of the engine, not shown in further detail, via a charge air line 26, and a throttle device 27 is inserted into the line connecting part 25 as will be described below.

The thrust rod 18 rests on a first end stop 28 when the engine is shut off or operating at idling rpm $n_L$ (see FIG. 2), and at a maximum charge air pressure $p_{Lmax}$, the total stroke h of the thrust rod 18 is defined by means of a second adjustable end stop **29*a* in cooperation with stop elements (34, 36) which will be described below. The first end stop 28 is embodied as an adjusting screw threaded into a screw sheath 30, and the second end stop 29*a* is embodied by the end face of a screw sheath 29, which is secured in a known manner by means of a holder spring, not shown, which has a detent in recesses 29*b* on the outer circumference of the sheath 29. A restoring spring 31 tends to keep the adjusting member 18 in its illustrated outset position defined by the first end stop 28 and enabling the execution of the total stroke h. The restoring spring 31 is supported at one end on the plate disk 16 connected with the thrust rod 18 and at the other end on a support ring 32 adjustably secured on the screw sheath 29; this restoring spring will hereafter be called the second restoring spring 31. The support ring 32 is secured by holding means in its illustrated position in the same manner as is the screw sheath 29**.

A first restoring spring 33 is disposed coaxially inside the second restoring spring 31 and in a known manner influences an adjusting stroke $h_L$ of the adjusting member 18 which is controlled in accordance with charge pressure. The restoring spring 33 is supported at one end on a first abutment 16*a* connected firmly to the thrust rod 18, this abutment being embodied by the surface of the plate disk 16, and rests on the other end on a second abutment 34 displaceably guided on the thrust rod 18. The second abutment 34, embodied in the form of a spring plate, is located in the illustrated position on a stop shoulder 35, embodied by a fastening ring, of the thrust rod 18, and it is spaced apart from the second end stop 29*a* by a distance determing a damping stroke $h_D$. With the damping stroke $h_D$ already having been established, the charge-pressure-dependent adjusting stroke $h_L$ is fixed by the distance between the second abutment 34 and a stop sheath 36 adjustably secured on the thrust rod 18. The stop sheath 36 is screwed to this end on a threaded portion 18*a* of the thrust rod 18 and is held in a manner secured against rotation by means of two guide faces 36*a* in a correspondingly shaped recess 37*a* of a sheath 37 guided rotatably on the thrust rod 18 and held in its illustrated position by means of a nut 38. The sheath 37 in turn carries a nut 39 which is adapted to secure the adjusting diaphragm 15 in place between the two plate disks 16 and 17.

The total stroke h of the thrust rod 18 is composed of the adjusting stroke $h_L$ controlled in accordance with charge pressure and the damping stroke $h_D$, and the stroke/time characteristic of the damping stroke $h_D$ is substantially determined by the throttle device 27 and the action of the restoring spring 31.

The throttle device 27 comprises a sequence valve which blocks the entire passage cross section A to the pressure chamber 24 when the charge air pressure $p_{L0}$ is absent and automatically opens once a predetermined charge air pressure $P_{L1}$ has been exceeded. The sequence valve is provided with a throttle opening 41 which bypasses its valve seat 27*a* in the blocking position of the sequence valve 27 shown in FIG. 1.

The sequence valve 27 is embodied as a diaphragm valve, the valve diaphragm 42 of which can be exposed on one side to the charge air pressure $p_L$ in the charge air line 26 and on the other side is stressed by a valve spring 43 whose prestressing force is adjustable to a valve opening pressure $p_{V0}$ dependent on the predetermined charge air pressure $P_{L1}$. The valve seat 27*a* and a movable valve member 27*b* of the sequence valve 27 are provided with valve seat faces which are plane-parallel to one another, and the throttle opening 41 is provided in one of the valve seat faces, in the present case being cut in the form of a throttle slit open toward the movable valve member 27 into one end face 44*a* of a tube 44 pressed into the connector element 25. This shaping of the throttle opening 41 permits relatively simple manufacture and additionally has a self-cleaning effect.

In the present example, the partial strokes $h_L$ and $h_D$ can be influenced independently of one another substantially by means of respective restoring springs 33 and 31; however, modifications of the present structure are also possible where the springs cooperate in a different manner without restricting the overall function. The prestressing force of the respective springs, their installed length and spring characteristic as well as the point at which they begin to function determine the dynamic acceleration curve H of the engine shown in dashed lines in FIG. 2.

Figure 2:
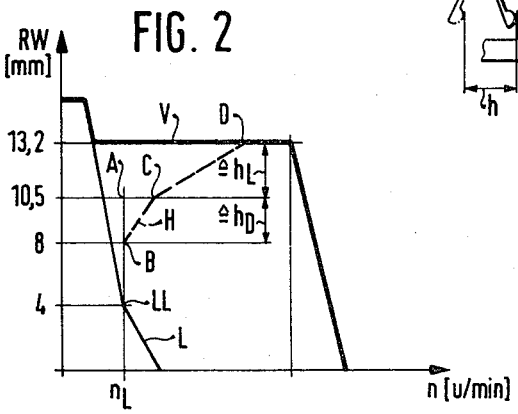
FIG. 2 is a control-path/rpm diagram to illustrate the mode of operation of the control apparatus.

In the diagram shown in FIG. 2, the control path RW of the supply quantity adjusting member 21 is indicated in millimeters and plotted over the rpm n. V represents the pre-load characteristic, L indicates a control curve of the idling spring thereby permitting an increased starting quantity of fuel, with the idling point LL at 4 mm of control path. At 8 mm of control path, the damping stroke $h_D$ begins, and at 10.5 mm the following adjusting stroke $h_L$ controlled in accordance with charge pressure begins (known charge-pressure-dependent full-load stops function only with the adjusting stroke $h_L$). If the engine is operating at the idling point LL, and if the driving pedal is depressed fully in order to establish a larger injection quantity, then the supply quantity adjusting member 21 would abruptly strike point A at control path 10.5 mm, which would cause smoke to be emitted because the engine rpm and the increase in power do not correspond to this increase in fuel quantity. By means of the throttle device 27 inserted into the charge air line 26 and the control apparatus 13 designed for the throttle stroke $h_D$, the supply quantity adjusting member 21 is already intercepted at point B upon acceleration, and it travels in a delayed manner corresponding to curve H toward point C. As a result, smoke formation is prevented. Between C and a point marked D on the full-load curve V, the adjusting stroke $h_L$ of the thrust rod 18 controlled in accordance with charge pressure then occurs; as a result, the thrust rod 18 displaces the bell crank 19 into the pivoted position indicated by dot-dash lines in FIG. 1. As a result, the supply quantity corresponding to the maximum charge air pressure $p_{Lmax}$ is directed at 13.2 mm of control path.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A charge-pressure-dependent control apparatus for supercharged fuel injected diesel engines having a movable wall displaceable counter to the force of at least one first restoring spring in accordance with charge air pressure ($P_L$) in an air inlet tube of said engine, said movable wall arranged to control the stroke of an adjusting member which varies the adjusting range as well as the full-load position of a supply quantity adjusting member of a fuel injection pump, said apparatus further including a pressure chamber connected via a charge air line to said air inlet tube and defined by said movable wall, further wherein the stroke of said adjusting member is defined by a first adjustable end stop when said engine is shut off and/or is operating at idling rp m ($n_L$) and is defined by a second adjustable end stop at maximum charge air pressure ($P_{Lmax}$), characterized in that said stroke of said adjusting member is enlarged to a total stroke (h) comprising a damping stroke ($h_D$) which precedes an adjusting stroke ($h_L$) controlled solely in accordance with charge pressure, said damping stroke having a stroke/time characteristic which is determined by means of a throttling device inserted into a line connection from said charge air line to said pressure chamber, said device being switched off when said charge pressure is increasing, whereby the charge pressure flows undamped into said pressure chamber to act on said movable wall.

2. A control apparatus as defined by claim 1, wherein:

(a) said first end stop is secured in a positionally fixed manner in a position which determines the onset of the damping stroke ($h_D$);

(b) a restoring means tends to hold said adjusting member in an outset position fixed by means of said first end stop thereby enabling the execution of the said stroke (h); and (c) the throttle device comprises a sequence valve arranged to block an entire passage cross section (A) to the pressure chamber when said charge air pressure is absent ($P_{L0}$) and automatically opens said passage cross section (A) when another predetermined charge air pressure ($P_{L1}$) is exceeded, said sequence valve being further provided with a throttle, said throttle being effective only when said sequence valve is blocking said cross section (A).

3. A control apparatus as defined by claim 2, characterized in that said sequence valve is embodied as a diaphragm valve having opposite surfaces, one of said surfaces arranged to be exposed to said charge air pressure ($p_L$) and the other of said surfaces arranged to be stressed by a valve spring which is adjustable in terms of its prestressing force to a valve opening pressure ($p_{V\ddot{o}}$), which is dependent on the charge air pressure ($P_{L1}$).

4. A control apparatus as defined by claim 2 or 3, characterized in that said sequence valve further includes a valve seat and a movable valve member provided with valve seat faces which are plane-parallel to one another and further that said throttle opening is cut into one of said valve seat faces in the form of a throttle slit which is open toward the other one of said valve seat faces.

5. A control apparatus as defined by claim 2, characterized in that said adjusting member cooperates with a second restoring spring, preferably adjustable in terms of its prestressing force, said second restoring spring serving as said restoring means to enable the execution of the total stroke (a), and further arranged to urge said adjusting member in the direction toward said first end stop, and is effective on its own at least during the predominant portion of said damping stroke ($h_D$).

6. A control apparatus as defined by claim 1, characterized in that said first restoring spring is effective during said adjusting stroke ($h_L$) controlled in accordance with charge pressure and is supported at one end on a first abutment firmly connected with said adjusting member, said spring being also supported on another end on a second abutment displaceably guided on said adjusting member, said second abutment arranged to rest on a stop collar of said adjusting member at a distance from the second end stop which determines said damping stroke ($h_D$).

7. A control apparatus as defined by claim 6, characterized in that said adjusting stroke ($h_L$) can be fixed by means of the distance between said second abutment and a stop sheath adjustably secured on said adjusting member.

* * * * *